US008597072B1

(12) United States Patent
Lucas

(10) Patent No.: US 8,597,072 B1
(45) Date of Patent: Dec. 3, 2013

(54) POCKET BRA SYSTEM

(76) Inventor: Sharon J. Lucas, Belleair, FL (US)

( * ) Notice: Subject to any disclaimer, the term of this patent is extended or adjusted under 35 U.S.C. 154(b) by 276 days.

(21) Appl. No.: 13/066,822

(22) Filed: Apr. 26, 2011

(51) Int. Cl.
*A41C 3/00* (2006.01)

(52) U.S. Cl.
USPC ..... 450/89; 2/247

(58) Field of Classification Search
USPC ..... 2/247–251; 450/89, 36, 54–57
See application file for complete search history.

(56) References Cited

U.S. PATENT DOCUMENTS 2,624,881 A * 1/1953 Dunson ..... 450/89
3,747,545 A * 7/1973 Nicolay et al. ..... 112/68
4,263,678 A * 4/1981 Off ..... 2/247
5,496,205 A * 3/1996 Lee ..... 450/89
5,799,336 A * 9/1998 Cooper ..... 2/247
7,753,759 B2 * 7/2010 Pintor et al. ..... 450/89
8,257,140 B2 * 9/2012 Kenny ..... 450/89
2008/0032600 A1 * 2/2008 Updyke ..... 450/89
2009/0104845 A1 * 4/2009 Pintor et al. ..... 450/31
2009/0209173 A1 * 8/2009 Arledge et al. ..... 450/39

* cited by examiner

*Primary Examiner* — Gloria Hale

(57) ABSTRACT

A strap assembly includes a chest strap and shoulder straps. Similarly configured left and right cups are provided. Each cup has inside and outside surfaces. A rectangular patch is operatively associated with each cup. Each patch has upper and lower edges and interior and exterior edges. In this manner a periphery is coupled to an associated cup. A linear slit is formed in each patch parallel with, and closely spaced from, the upper edge of each patch. Each slit has an elastic band within the patch surrounding the slit. The elastic band is adapted to return the slit to a closed orientation. The elastic band is further adapted to allow the slit to stretch to an enlarged orientation.

9 Claims, 4 Drawing Sheets

FIG. 4
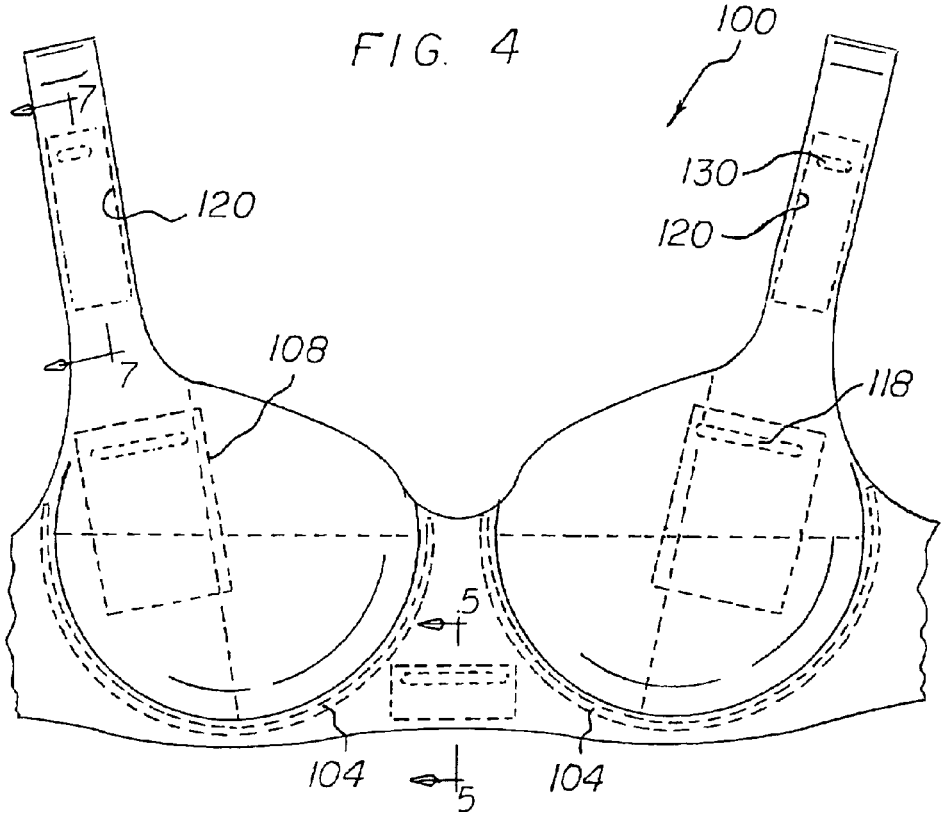
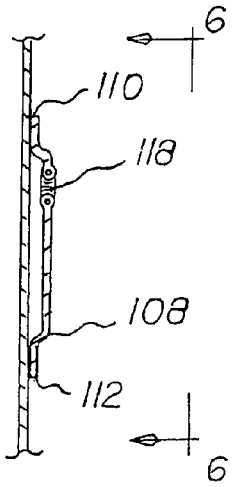
FIG. 5
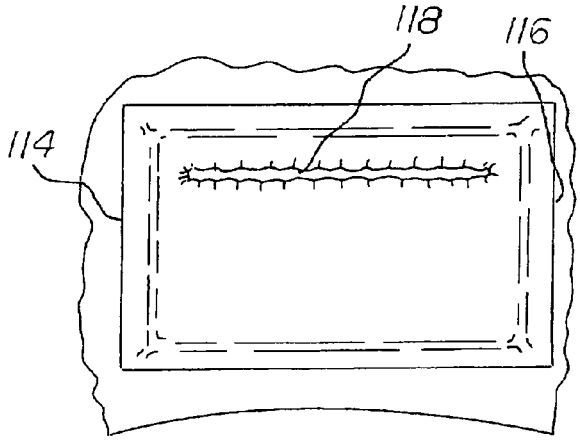
FIG. 6

POCKET BRA SYSTEM

BACKGROUND OF THE INVENTION

Field of the Invention

The present invention relates to a pocket bra system and more particularly pertains to removably receiving a hand held electronic device while providing support and shape to the breasts of a wearer, the receiving and supporting and shaping being done in a safe, convenient and economical manner.

SUMMARY OF THE INVENTION

In view of the disadvantages inherent in the known types of bra systems of known designs and configurations now present in the prior art, the present invention provides an improved pocket bra system. As such, the general purpose of the present invention, which will be described subsequently in greater detail, is to provide a new and improved pocket bra system and method which has all the advantages of the prior art and none of the disadvantages.

To attain this, the present invention essentially comprises a pocket bra system. First provided is a strap assembly. The strap assembly includes a generally horizontal chest strap. The chest strap is positionable around the chest and back of a wearer. The strap assembly includes left and right generally vertical shoulder straps. The shoulder straps are positionable over the shoulders of the wearer. The shoulder straps have free ends. The free ends are coupled to the chest strap adjacent to the chest of the wearer and adjacent to the back of the wearer.

A left cup is provided. A similarly configured right cup is provided. Each cup has an inside surface and an outside surface. The left and right cups each have an upper-most point. The left and right cups each have a lower-most point. A generally vertical axis is provided. The vertical axis divides each cup into an inner hemisphere interiorly and an outer hemisphere exteriorly. The left and right cups each have an inner-most point. The left and right cups each have an outer-most point. A generally horizontal axis is provided. The horizontal axis divides each cup into an upper hemisphere above and a lower hemisphere below.

A rectangular patch is provided next. The patch is operatively associated with each cup. Each patch has generally horizontal upper and lower edges. Each patch has generally vertical interior and exterior edges. The patch has a periphery. The periphery has stitching. In this manner the periphery of each patch is coupled to the inside surface of an associated cup. The majority of each patch is in the upper hemisphere. The majority of each patch is in the outer hemisphere. A rectangular chamber is provided. The chamber is provided between each patch and its associated cup. The chamber is rectangular. The chamber has a height of 120 and 140 millimeters. The chamber has a width of between 60 and 70 millimeters. The pockets and the patches are fabricated of a resilient closed cell polyurethane foam. The foam has a thickness of between 2 and 4 millimeters.

Further provided is a linear slit. The slit is provided in each patch. The slit is provided parallel with, and closely spaced from, the upper edge of each patch. Each slit has a length greater than 90 percent of the width of the chamber. An elastic band is provided. The elastic band is provided within each patch. The elastic band surrounds the slit. The elastic band is adapted to return the slit to a closed orientation. The elastic band is further adapted to allow the slit to stretch to an enlarged orientation.

Provided last is a hand held electronic device. The hand held electronic device is positionable within the chamber. The hand held electronic device has a height of 115 millimeters, plus or minus 10 percent. The hand held electronic device has a width of 59 millimeters. The hand held electronic device has a thickness of 9 millimeters plus or minus 10 percent. The slit is adapted to stretch to the open orientation when adding the hand held device to, or removing the hand held device from, the chamber. The slit is adapted to contract to the closed orientation when the hand held device is within or without the chamber. The thickness and the material of the cups and the patches are adapted to abate inward projections by the hand held devices in the chambers tending to poke a user. The thickness and the material of the cups and the patches are adapted to abate outward projections by the hand held devices in the chambers tending to create unsightly projections.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pocket bra system which has all of the advantages of the prior art bra systems of known designs and configurations and none of the disadvantages.

It is another object of the present invention to provide a new and improved pocket bra system which may be easily and efficiently manufactured and marketed.

It is further object of the present invention to provide a new and improved pocket bra system which is of durable and reliable constructions.

An even further object of the present invention is to provide a new and improved pocket bra system which is susceptible of a low cost of manufacture with regard to both materials and labor, and which accordingly is then susceptible of low prices of sale to the consuming public, thereby making such pocket bra system economically available to the buying public.

Even still another object of the present invention is to provide a pocket bra system for removably receiving a hand held electronic device while providing support and shape to the breasts of a wearer, the receiving and supporting and shaping being done in a safe, convenient and economical manner.

Lastly, it is an object of the present invention to provide a new and improved pocket bra system. A strap assembly includes a chest strap and shoulder straps. Similarly configured left and right cups are provided. Each cup has inside and outside surfaces. A rectangular patch is operatively associated with each cup. Each patch has upper and lower edges and interior and exterior edges. In this manner a periphery is coupled to an associated cup. A linear slit is formed in each patch parallel with, and closely spaced from, the upper edge of each patch. Each slit has an elastic band within the patch surrounding the slit. The elastic band is adapted to return the slit to a closed orientation. The elastic band is further adapted to allow the slit to stretch to an enlarged orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a front elevational view of a pocket bra system constructed in accordance with an alternate embodiment of the invention.

FIG. 5 is a cross sectional view taken along line 5-5 of FIG. 4.

FIG. 6 is a rear elevational view taken along line 6-6 of FIG. 5.

The same reference numerals refer to the same parts throughout the various Figures.

DESCRIPTION OF THE PREFERRED EMBODIMENT

Figure 1:
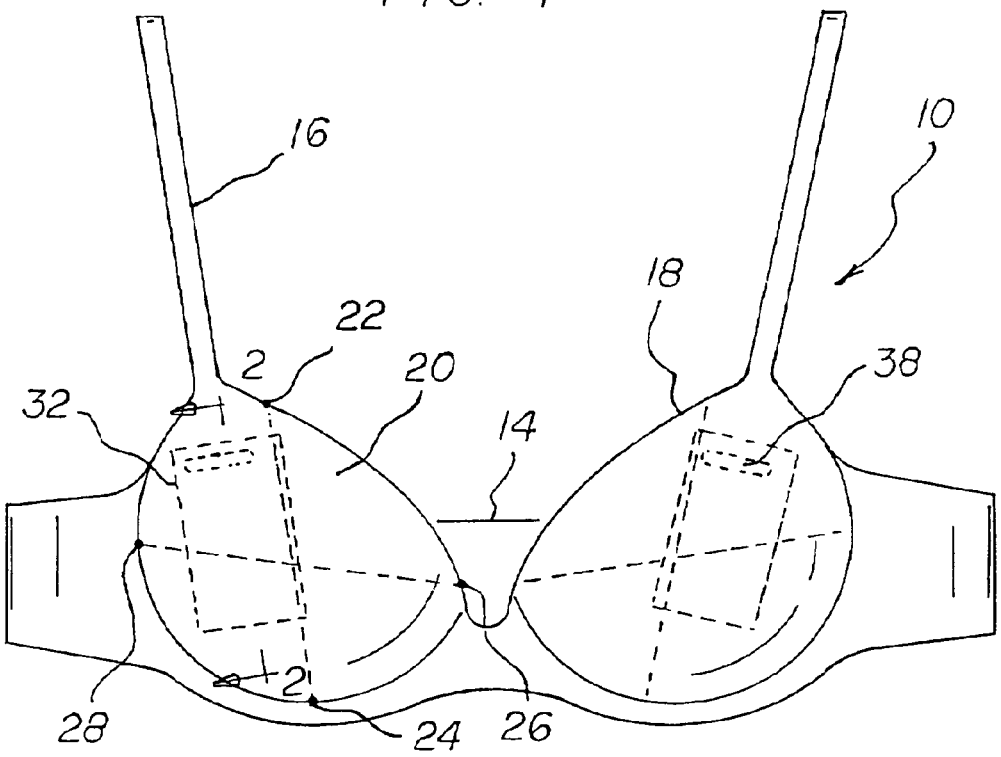
FIG. 1 is a front elevational view of a pocket bra system constructed in accordance with the principles of the present invention.
Figure 2:
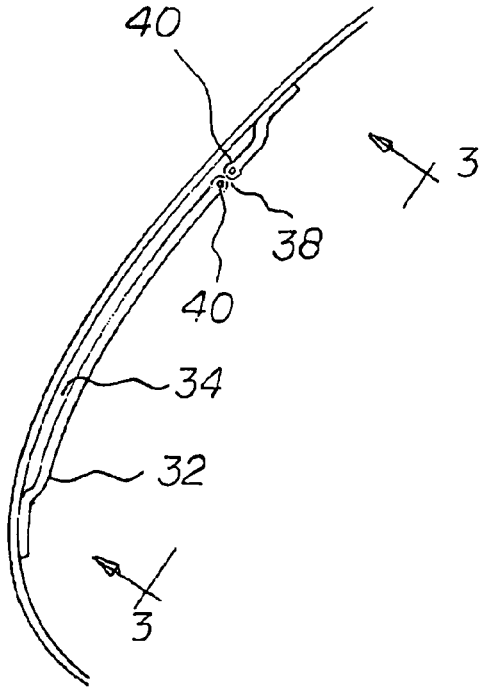
FIG. 2 is a cross sectional view taken along line 2-2 of FIG. 1.
Figure 3:
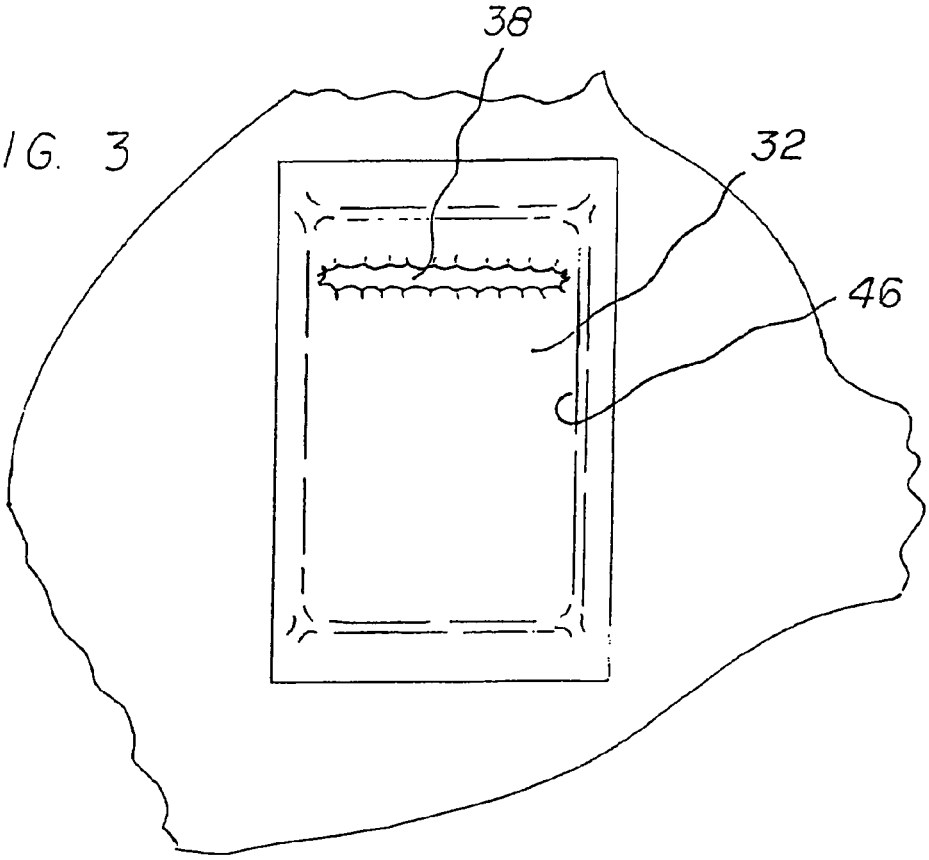
FIG. 3 is a rear elevational view taken along line 3-3 of FIG. 2.
Figure 7:
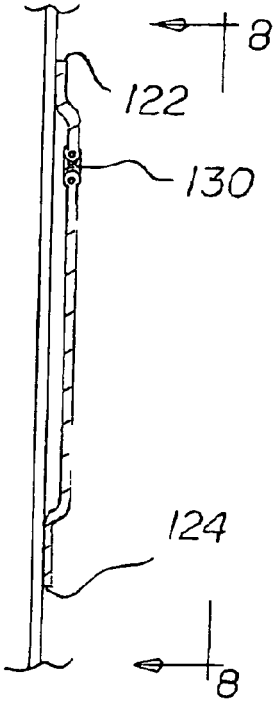
FIG. 7 is a cross sectional view taken along line 7-7 of FIG. 4.
Figure 8:
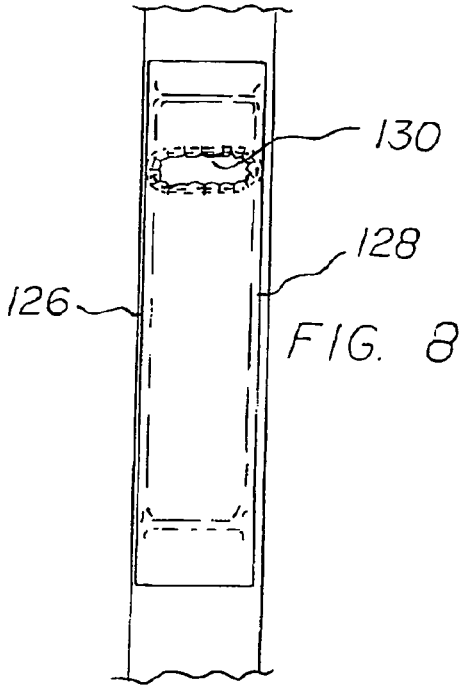
FIG. 8 is a rear elevational view taken along line 8-8 of FIG. 7.

With reference now to the drawings, and in particular to FIG. 1 thereof, the preferred embodiment of the new and improved pocket bra system embodying the principles and concepts of the present invention and generally designated by the reference numeral 10 will be described.

The present invention, the pocket bra system 10 is comprised of a plurality of components. Such components in their broadest context include a strap, left and right cups, a rectangular patch and a linear slit. Such components are individually configured and correlated with respect to each other so as to attain the desired objective.

First provided is a strap assembly. The strap assembly includes a generally horizontal chest strap 14. The chest strap is positionable around the chest and back of a wearer. The strap assembly includes left and right generally vertical shoulder straps 16. The shoulder straps are positionable over the shoulders of the wearer. The shoulder straps have free ends. The free ends are coupled to the chest strap adjacent to the chest of the wearer and adjacent to the back of the wearer.

A left cup 18 is provided. A similarly configured right cup 20 is provided. Each cup has an inside surface and an outside surface. The left and right cups each have an upper-most point 22. The left and right cups each have a lower-most point 24. A generally vertical axis is provided. The vertical axis divides each cup into an inner hemisphere interiorly and an outer hemisphere exteriorly. The left and right cups each have an inner-most point 26. The left and right cups each have an outer-most point 28. A generally horizontal axis is provided. The horizontal axis divides each cup into an upper hemisphere above and a lower hemisphere below.

A rectangular patch 32 is provided next. The patch is operatively associated with each cup. Each patch has generally horizontal upper and lower edges. Each patch has generally vertical interior and exterior edges. The patch has a periphery. The periphery has stitching. In this manner the periphery of each patch is coupled to the inside surface of an associated cup. The majority of each patch is in the upper hemisphere. The majority of each patch is in the outer hemisphere. A rectangular chamber 34 is provided. The chamber is provided between each patch and its associated cup. The chamber is rectangular. The chamber has a height of 120 and 140 millimeters. The chamber has a width of between 60 and 70 millimeters. The pockets and the patches are fabricated of a resilient closed cell polyurethane foam. The foam has a thickness of between 2 and 4 millimeters.

Further provided is a linear slit 38. The slit is provided in each patch. The slit is provided parallel with, and closely spaced from, the upper edge of each patch. Each slit has a length greater than 90 percent of the width of the chamber. An elastic band 40 is provided. The elastic band is provided within each patch. The elastic band surrounds the slit. The elastic band is adapted to return the slit to a closed orientation. The elastic band is further adapted to allow the slit to stretch to an enlarged orientation.

Provided last is a hand held electronic device 46. The hand held electronic device is positionable within the chamber. The hand held electronic device has a height of 115 millimeters, plus or minus 10 percent. The hand held electronic device has a width of 59 millimeters. The hand held electronic device has a thickness of 9 millimeters plus or minus 10 percent. The slit is adapted to stretch to the open orientation when adding the hand held device to, or removing the hand held device from, the chamber. The slit is adapted to contract to the closed orientation when the hand held device is within or without the chamber. The thickness and the material of the cups and the patches are adapted to abate inward projections by the hand held devices in the chambers tending to poke a user. The thickness and the material of the cups and the patches are adapted to abate outward projections by the hand held devices in the chambers tending to create unsightly projections.

An alternate embodiment 100 of the present invention is provided. An under-wire 104 is provided. The under-wire is provided beneath each cup.

A central patch 108 is provided. The central patch is provided intermediate the cups. In this manner a central chamber is formed. The central patch has horizontal upper and lower edges 110, 112. The central patch has vertical side edges 114, 116. The upper and lower edges are longer than the side edges. The central patch has a central slit 118. The central slit is provided parallel with and in proximity to the upper edge. The central chamber is adapted to receive and support keys.

An upper patch 120 is provided on each shoulder strap. The upper patches have horizontal upper and lower edges 122, 124. The upper patches have vertical side edges 126, 128. The upper and lower edges are shorter than the side edges. The upper patches each have an upper slit 130. The upper slit is provided parallel with and in proximity to the upper edge. The upper chambers are adapted to receive and support pills.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bra pocket system comprising:

a strap assembly including a chest strap and shoulder straps;

similarly configured left and right cups, each cup having inside and outside surfaces, the strap assembly being attached to the cups whereby the strap assembly adheres the cups to a wearer;

a rectangular patch operatively associated with each cup, each patch having upper and lower edges and interior and exterior edges forming a periphery coupled to an associated cup forming a pocket between the patch and the cup; and a linear slit formed in each patch parallel with, and closely spaced from, the upper edge of each patch, each slit having an elastic band within the patch surrounding the slit adapted to return the slit to a closed orientation and to allow the slit to stretch to an enlarged orientation.

2. The system as set forth in claim 1 wherein each cup has an inside surface and an outside surface, the left and right cups each having an upper-most point and a lower-most point with a generally vertical axis dividing each cup into an inner hemisphere interiorly and an outer hemisphere exteriorly, the left and right cups each having an inner-most point and an outer-most point with a generally horizontal axis dividing each cup into an upper hemisphere above and a lower hemisphere below.

3. The system as set forth in claim 2 wherein the cups and the patches form pockets, the cups and the patches being fabricated of a resilient closed cell polyurethane foam with a thickness of between 2 and 4 millimeters.

4. The system as set forth in claim 3 and further including a hand held electronic device, the hand held electronic device being placeable within the pocket.

5. The system as set forth in claim 1 and further including an under-wire coupled beneath each cup in a generally horizontal plane.

6. The system as set forth in claim 5 and further including a central patch intermediate the cups to form a central chamber, the central patch having horizontal upper and lower edges and vertical side edges, the upper and lower edges being longer than the side edges, the central patch having a central slit parallel with and in proximity to the upper edge, the central chamber adapted to receive and support keys.

7. The system as set forth in claim 5 and further including an upper patch on each shoulder strap, the upper patches having horizontal upper and lower edges and vertical side edges, the upper and lower edges being shorter than the side edges, the upper patches each having an upper slit parallel with and in proximity to the upper edge, the upper chambers adapted to receive and support pills.

8. A bra pocket system for removably receiving a hand held electronic device while providing support and shape to the breasts of a wearer, the system comprising, in combination:

a strap assembly including a generally horizontal chest strap positionable around the chest and back of a wearer, the strap assembly including left and right generally vertical shoulder straps positionable over the shoulders of the wearer, the shoulder straps having free ends coupled to the chest strap adjacent to the chest of the wearer and adjacent to the back of the wearer;

a left cup and a similarly configured right cup, each cup having an inside surface and an outside surface, the left and right cups each having an upper-most point and a lower-most point with a generally vertical axis dividing each cup into an inner hemisphere interiorly and an outer hemisphere exteriorly, the left and right cups each having an inner-most point and an outer most point with a generally horizontal axis dividing each cup into an upper hemisphere above and a lower hemisphere below, the strap assembly being attached to the cups whereby the strap assembly adheres the cups to a wearer;

a rectangular patch operatively associated with each cup, each patch having generally horizontal upper and lower edges and vertical left and right edges, a periphery with stitching coupling the periphery of each patch to the inside surface of an associated cup, the majority of each patch being in the upper hemisphere, the majority of each patch being in the outer hemisphere, a rectangular pocket formed between each patch and its associated cup, the pocket being rectangular with a height of 120 and 140 millimeters, the pocket having a width of between 60 and 70 millimeters, the cups and the patches being fabricated of a resilient closed cell polyurethane foam with a thickness of between 2 and 4 millimeters;

a linear slit formed in each patch parallel with, and closely spaced from, the upper edge of each patch, each slit having a length greater than 90 percent of the width of the pocket, an elastic band within each patch surrounding the slit adapted to return the slit to a closed orientation and to allow the slit to stretch to an enlarged orientation; and a hand held electronic device within the chamber, the hand held electronic device having a height of 115 millimeters, plus or minus 10 percent, a width of 59 millimeters and a thickness of 9 millimeters plus or minus 10 percent, the slit adapted to stretch to the open orientation when adding the hand held device to, or removing the hand held device from, the pocket, the slit adapted to contract to the closed orientation when the hand held device is within or without the pocket.

9. A pocket bra system comprising:

a strap assembly including a chest strap and shoulder straps;

similarly configured left and right cups, each cup having inside and outside surfaces;

a rectangular patch operatively associated with each cup, each patch having upper and lower edges and left and right edges forming a periphery coupled to an associated cup forming a pocket between the patch and the cup, the strap assembly being attached to the cups whereby the strap assembly adheres the cups to a wearer; and a linear slit formed in each patch parallel with, and closely spaced from, the upper edge of each patch, the linear slit being the only entry means into the pocket for allowing items to be inserted and removed from the pocket that is formed by the attachment of the patch to the bra.

* * * * *